US008151938B2

(12) United States Patent
Kinskey

(10) Patent No.: US 8,151,938 B2
(45) Date of Patent: Apr. 10, 2012

(54) TOOL CASE FOR ENGAGING A LADDER

(75) Inventor: Terry Kinskey, Alpharetta, GA (US)

(73) Assignee: LF Centennial Limited, Tortola (VG)

( * ) Notice: Subject to any disclaimer, the term of this patent is extended or adjusted under 35 U.S.C. 154(b) by 727 days.

(21) Appl. No.: 11/122,286

(22) Filed: May 4, 2005

(65) Prior Publication Data

US 2006/0000830 A1 Jan. 5, 2006

Related U.S. Application Data

(60) Provisional application No. 60/567,956, filed on May 4, 2004.

(51) Int. Cl.
*B65D 85/28* (2006.01)

(52) U.S. Cl. ..... 182/129; 182/230; 220/751; 220/735; 206/349; 206/372; 206/373; 248/210

(58) Field of Classification Search ..... 220/751, 220/735; 182/129, 230; 206/349, 373, 372; 248/210

See application file for complete search history.

(56) References Cited

U.S. PATENT DOCUMENTS

| | | | | | |
|---|---|---|---|---|---|
| 4,356,854 | A | | 11/1982 | McGee | |
| 4,653,713 | A | | 3/1987 | Hamilton | |
| 4,726,446 | A | * | 2/1988 | Perbix | 182/46 |
| 5,342,008 | A | | 8/1994 | Kay | |
| 5,402,910 | A | | 4/1995 | Pilney | |
| 5,419,409 | A | | 5/1995 | Corulla | |
| 5,603,405 | A | | 2/1997 | Smith | |
| 5,638,915 | A | * | 6/1997 | Hardy | 182/129 |
| 5,639,003 | A | * | 6/1997 | Utzinger, III | 224/577 |
| 5,647,453 | A | * | 7/1997 | Cassells | 182/129 |
| 5,649,623 | A | * | 7/1997 | Kornblatt | 206/373 |
| 5,749,437 | A | * | 5/1998 | Weller | 182/129 |
| 5,813,530 | A | | 9/1998 | Kornblatt | |
| 5,901,998 | A | | 5/1999 | Gallo, Jr. | |
| 5,941,344 | A | * | 8/1999 | Spadaro | 182/129 |
| 5,950,972 | A | * | 9/1999 | Irish | 248/210 |
| 5,988,383 | A | * | 11/1999 | Armstrong | 206/373 |
| 6,012,689 | A | * | 1/2000 | Sisca | 248/210 |
| 6,334,509 | B1 | * | 1/2002 | Ryszkiewicz | 182/129 |
| 6,401,862 | B1 | * | 6/2002 | Caron | 182/129 |
| 6,435,304 | B1 | * | 8/2002 | Stierle | 182/129 |
| 6,467,577 | B1 | | 10/2002 | Charlebois, Jr. | |
| 6,564,941 | B2 | * | 5/2003 | Hedges | 206/373 |
| 6,766,881 | B2 | * | 7/2004 | Carty | 182/129 |
| 6,991,104 | B2 | * | 1/2006 | Redzisz | 206/373 |
| 7,055,652 | B1 | * | 6/2006 | Williams | 182/129 |
| 7,195,119 | B2 | * | 3/2007 | Lungo | 206/373 |
| 2002/0070137 | A1 | * | 6/2002 | Hedges | 206/373 |
| 2006/0124488 | A1 | * | 6/2006 | Redzisz | 206/373 |
| 2006/0219587 | A1 | * | 10/2006 | Redzisz et al. | 206/373 |

* cited by examiner

*Primary Examiner* — Alvin Chin Shue
*Assistant Examiner* — Colleen M Chavchavadze
(74) *Attorney, Agent, or Firm* — Duane Morris LLP; J. Rodman Steele; Gregory M. Lefkowitz

(57) ABSTRACT

A tool case for engaging a ladder comprises a skeleton, having a horizontal top surface and a vertical surface, extending from the horizontal top surface, the vertical surface and the horizontal top surface defining a compartment. The tool case also comprises a horizontal bottom surface and another vertical surface, extending from the horizontal bottom surface, the vertical surface and the horizontal bottom surface defining a cavity for receiving a top portion of the ladder.

14 Claims, 9 Drawing Sheets

TOOL CASE FOR ENGAGING A LADDER

CROSS REFERENCES TO RELATED APPLICATIONS

This application claims priority from U.S. Provisional Application Ser. No. 60/567,956 filed May 4, 2004, the entire disclosure of which is incorporated herein by this reference.

FIELD OF THE INVENTION

The present invention relates to a case for holding tools, and, more specifically, to a case adapted for use with a ladder.

BACKGROUND OF INVENTION

A desirable tool case serves several functions, for example, providing a location for tools to be stored and easily located when they are needed. Tools are often needed when a user is performing tasks in elevated positions on a ladder. As such, certain devices have been developed for supporting tools and/or other articles upon a ladder. However, these devices often fail to serve the functions expected from desirable tool cases. Also, such known devices often do not allow tools to be easily organized and readily accessed and/or have very limited storage capacity.

Additionally, such known devices are often unstable when placed upon a ladder and/or are difficult to use in locations away from a ladder. For example, U.S. Pat. No. 4,356,854 describes a pouch having a flexible skirt, which may hang around the top of a step ladder. When the flexible pouch is positioned on the ladder, the weight of articles in its pockets, particularly the side pockets that hang with the flexible skirt around the top of the ladder, stabilize the pouch on the ladder. As such, the stability of the pouch on the ladder is dependent upon having tools of a particular weight positioned in particular pockets of the pouch; such stability could be jeopardized if a weighty tool were removed from the pocket and used. Additionally, the flexible pouch collapses when positioned on other surfaces, such as a table-top or a floor, making it difficult to use in locations away from the ladder.

Furthermore, certain known devices are often of a design that is cumbersome to manufacture, to store and to use. For example, U.S. Pat. No. 5,901,998 describes a tool carrier that is made from a strong lightweight material, such as plastic, having a recess formed in a bottom surface and various cavities molded through an upper surface, shaped to hold particular tools. In this regard, the tool carrier has a molded, rigid construction that can be cumbersome to manufacture, store and maneuver. Additionally, the tool carrier's molded cavities are designed to hold particular tools; once formed, these cavities are not appropriate for holding other tools that may be useful or desirable in certain situations.

As such, there is a need in the art for a device that satisfactorily addresses the above-mentioned problems associated with known devices designed for supporting tools and/or other articles upon a ladder.

SUMMARY OF THE INVENTION

The present invention addresses the above-identified problems, and others, by providing a tool case, which is adapted to engage a ladder, provides ample storage capacity, allows for tools to be easily organized and readily accessed, has a beneficial multi-piece construction, and allows for efficient use upon a ladder, as well as in locations away from a ladder.

The tool case of the present invention is constructed from a substantially rigid skeleton made, for example, from a molded polymer or a metal. Furthermore, the tool case may include flexible elements. For example, an embodiment of the tool case has a rigid skeleton that is covered with durable fabric material. The tool case may also or alternatively include a casing associated with the skeleton, which is made from a flexible material, such as a polymer or metal sheet that provides a stable surface, but may be flexed. An embodiment of the tool case includes a casing that is positioned substantially adjacent to and is joined to the skeleton.

Generally, the skeleton has a substantially horizontal bottom surface and at least one substantially vertical surface extending from the horizontal bottom surface, which together define a cavity for receiving a top portion of a ladder. A single continuous vertical surface extending from the horizontal bottom surface may be provided, or multiple vertical surfaces may be provided, as long as the one or more vertical surfaces and the horizontal bottom surface define a cavity capable of receiving a top portion of a ladder.

Additionally, the skeleton has a substantially horizontal top surface and at least one substantially vertical surface extending from the horizontal top surface, which together define a compartment for holding tools. A single continuous vertical surface extending from the horizontal top surface may be provided, or multiple vertical surfaces may be provided, as long as the one or more vertical surfaces and the top surface define a compartment capable of holding tools. In any event, the accessible surfaces of the skeleton are provided with various means for holding and organizing tools and accessories, for example, pockets, straps or brackets.

In an embodiment of the tool case, the substantially horizontal top surface and the substantially horizontal bottom surface are provided on a single component, a base having a top surface and a bottom surface. Additionally, in the embodiment of the tool case, the vertical surfaces extending from the horizontal top surface and the vertical surfaces extending from the horizontal bottom surface are provided by four side walls having upper portions extending upwardly from the base, and lower portions extending downwardly from the base. Thus, the base, together with the upper portions of the side walls define a compartment for holding tools, while the base, together with the lower portions of the side walls define a cavity capable of receiving a top portion of a ladder.

DETAILED DESCRIPTION OF THE INVENTION

Figure 1:
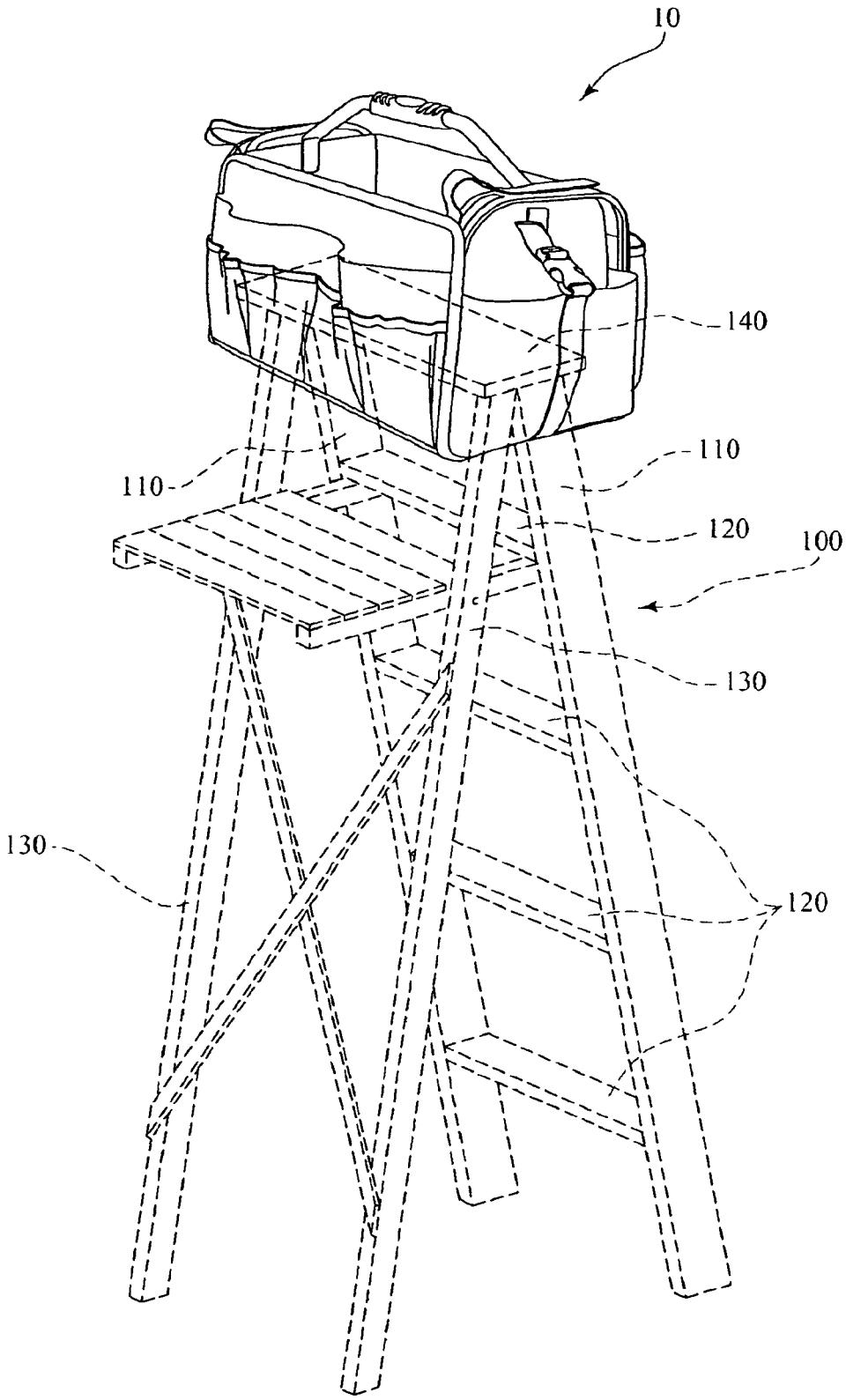
FIG. 1 is a perspective view of an exemplary tool case positioned on a ladder.

The present invention is a tool case adapted to engage a ladder and is designed to hold, store, and organize a variety of tools, while permitting the tools to be readily accessed from the tool case, whether the case is being used upon or away from a ladder. For example, as shown in FIG. 1, an illustrated embodiment of the tool case 10 may be positioned on the top of a step ladder 100.

The tool case of the present invention is constructed from a substantially rigid skeleton made, for example, from a molded polymer or a metal. Furthermore, the tool case may include flexible elements. For example, in the illustrated embodiment, the tool case 10 has a rigid skeleton that is covered with durable fabric material, such as a heavy nylon; however, it may be constructed from a variety of materials including PP webbing, various natural or synthetic cloths or leather. The tool case may also or alternatively include a casing associated with the skeleton, which is made from a flexible material, such as a polymer or metal sheet that provides a stable surface, but may be flexed. In the illustrated embodiment, the tool case 10 includes a casing that is positioned substantially adjacent to and is joined to the skeleton, as will be described below.

Generally, the skeleton has a substantially horizontal bottom surface and at least one substantially vertical surface extending from the horizontal bottom surface, which together define a cavity for receiving a top portion of a ladder. A single continuous vertical surface extending from the horizontal bottom surface may be provided, or multiple vertical surfaces may be provided, as long as the one or more vertical surfaces and the horizontal bottom surface define a cavity capable of receiving a top portion of a ladder.

Additionally, the skeleton has a substantially horizontal top surface and at least one substantially vertical surface extending from the horizontal top surface, which together define a compartment for holding tools. A single continuous vertical surface extending from the horizontal top surface may be provided, or multiple vertical surfaces may be provided, as long as the one or more vertical surfaces and the top surface define a compartment capable of holding tools. In any event, the accessible surfaces of the skeleton are provided with various means for holding and organizing tools and accessories, for example, pockets, straps or brackets.

In the illustrated embodiment of the tool case 10, as described with reference to FIGS. 2-4, the substantially horizontal top surface and the substantially horizontal bottom surface are provided on a single component, a base 12 having a top surface 12*a* and a bottom surface 12*b*. Additionally, in the illustrated embodiment, the vertical surfaces extending from the horizontal top surface and the vertical surfaces extending from the horizontal bottom surface are provided by four side walls 14, 16, 18, 20 having upper portions 14*a*, 16*a*, 18*a*, 20*a* extending upwardly from the base 12, and lower portions 14*b*, 16*b*, 18*b*, 20*b* extending downwardly from the base 12. Thus, the base 12, together with the upper portions 14*a*, 16*a*, 18*a*, 20*a* of the side walls 14, 16, 18, 20 define a compartment 22 for holding tools, while the base 12, together with the lower portions 14*b*, 16*b*, 18*b*, 20*b* of the side walls 14, 16, 18, 20 define a cavity 24 capable of receiving a top portion of a ladder. Although the compartment 22 of the illustrated embodiment is not subdivided, it is contemplated that it could be divided into multiple sub-compartments.

Figure 5:
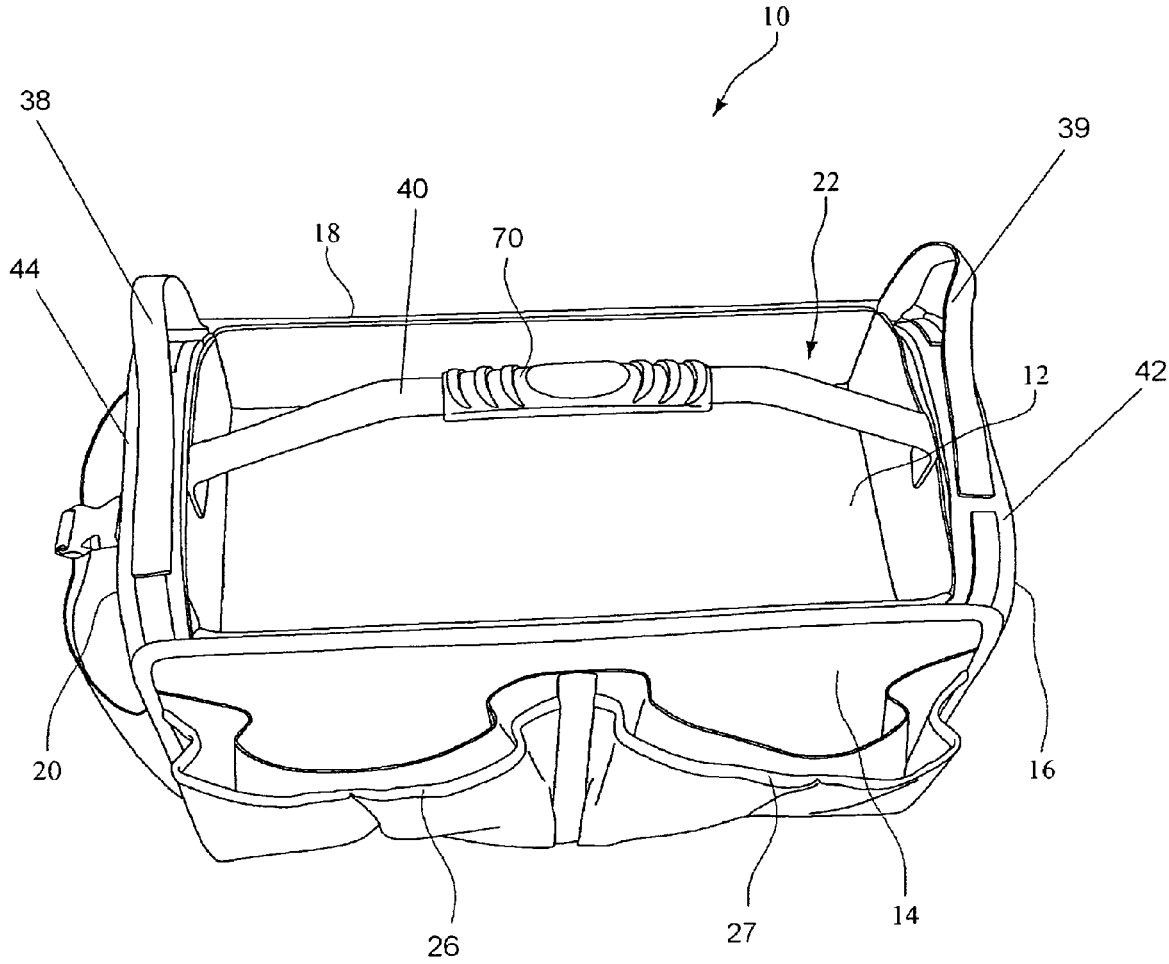
FIG. 5 is a top perspective view of the tool case of FIG. 1.

In addition to the compartment 22, the tool case 10 may include a variety of holding mechanisms for securing and organizing tools and accessories. For example, with reference to FIG. 5, secured to an outside surface of a first sidewall 14 of the tool case 10 is a pair of open pockets 26, 27 defining multiple spaces for holding and organizing tools and accessories of various shapes and sizes. For another example, with reference to FIGS. 2 and 6, secured to an outside surface of a second sidewall 16 of the embodiment is a pair of pouches 28, 29 for holding and organizing tools and accessories of various shapes and sizes. The pouches 28, 29 include closure flaps 28', 29' to selectively close the openings into the pouches 28, 29 allowing small items, such as nails or screws, to be easily retained therein.

Figure 2:
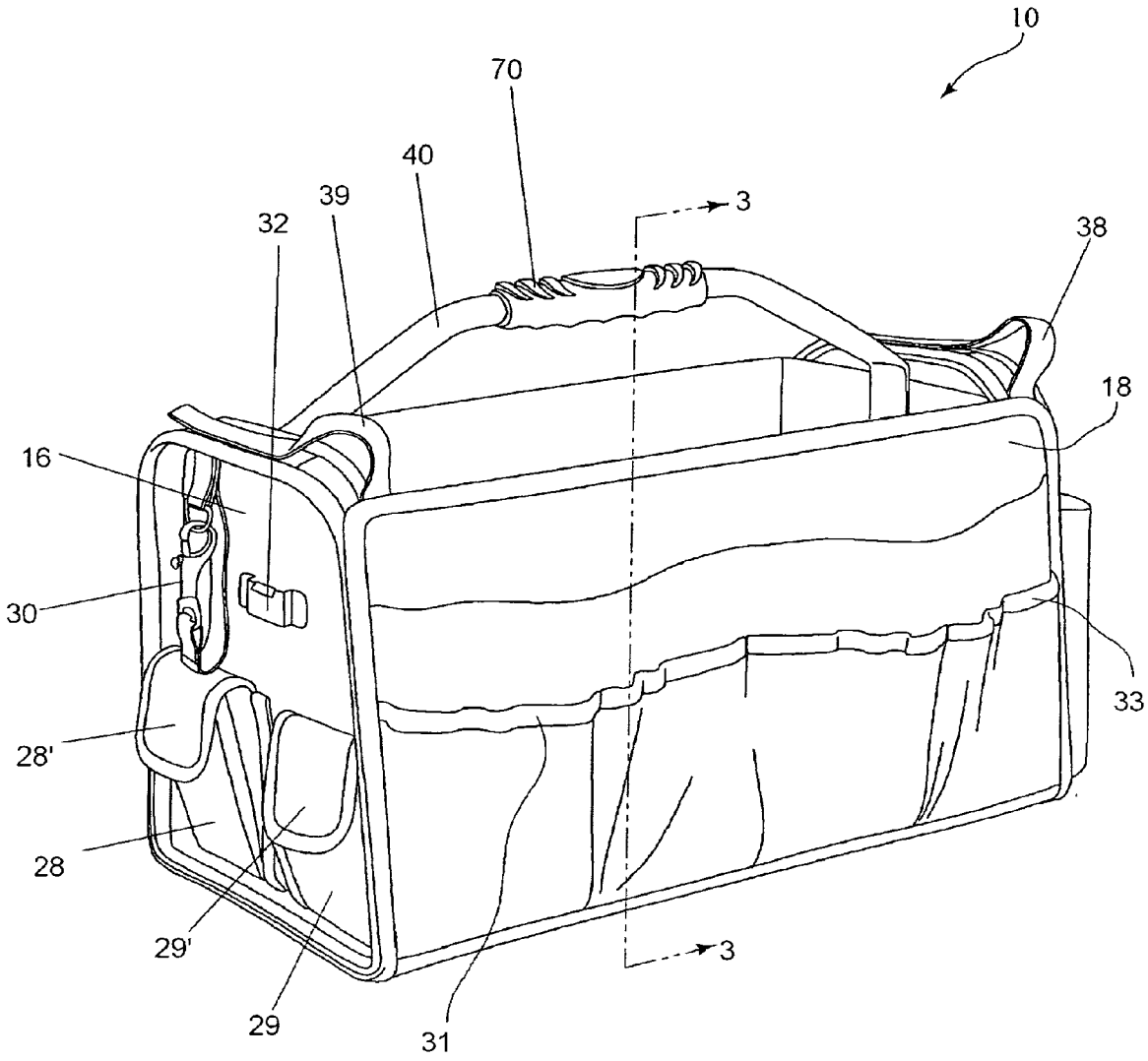
FIG. 2 is side perspective view of the tool case of FIG. 1.
Figure 6:
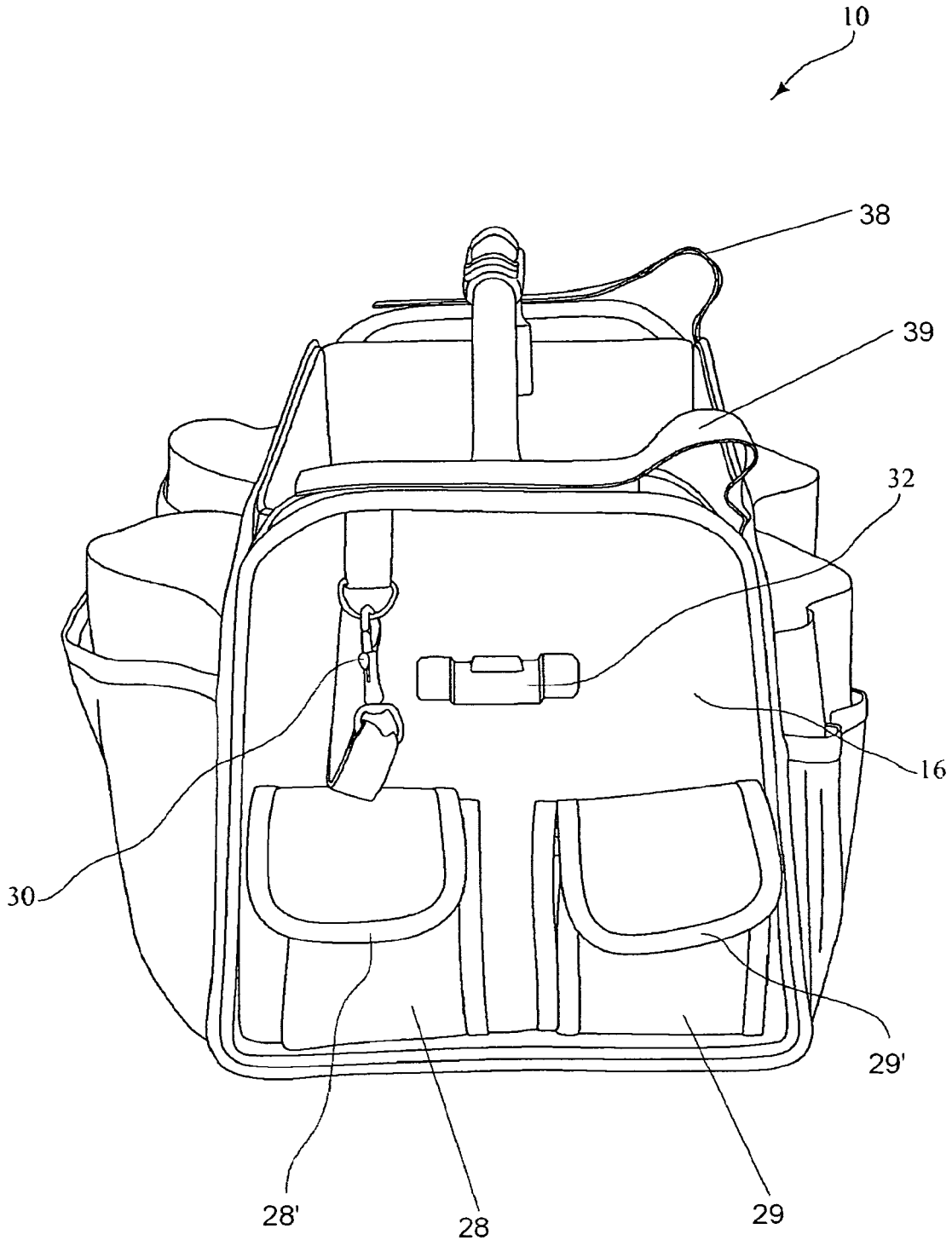
FIG. 6 is an end perspective view of the tool case of FIG. 1.

Still referring to FIGS. 2 and 6, also secured to the second sidewall 16 of the tool case 10 is a strap and clasp combination 30, which may be clipped onto various items for securing the items to the tool case 10. A bracket 32 is also provided on the second sidewall 16 for securing additional items to the tool case 10.

Figure 7:
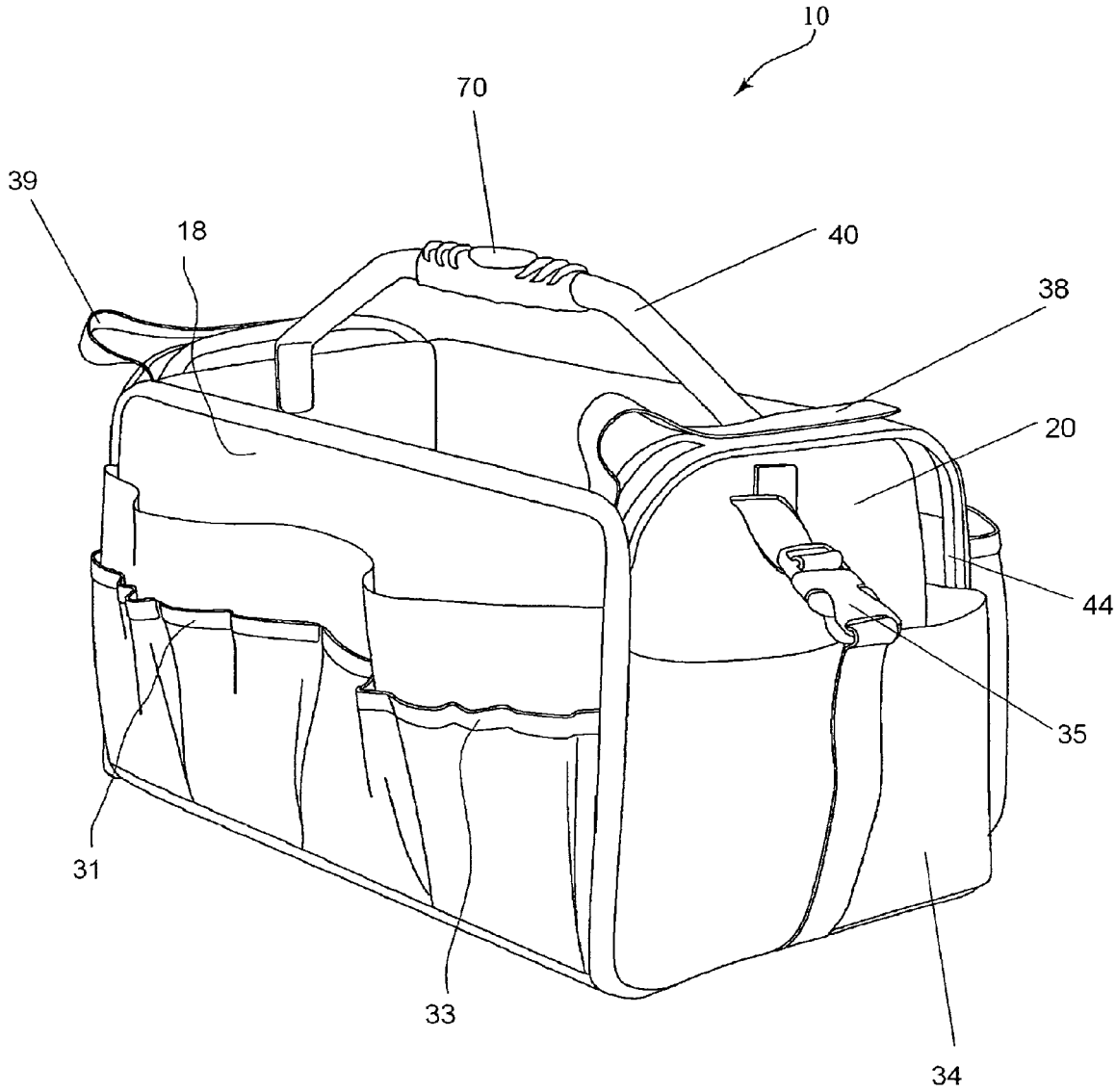
FIG. 7 is an alternate side perspective view of the tool case of FIG. 1.

Referring now to FIGS. 2 and 7, secured to an outside surface of a third sidewall 18 of the tool case 10 are another pair of open pockets 31, 33 defining multiple spaces for holding and organizing tools and accessories of various shapes and sizes.

Figure 8:
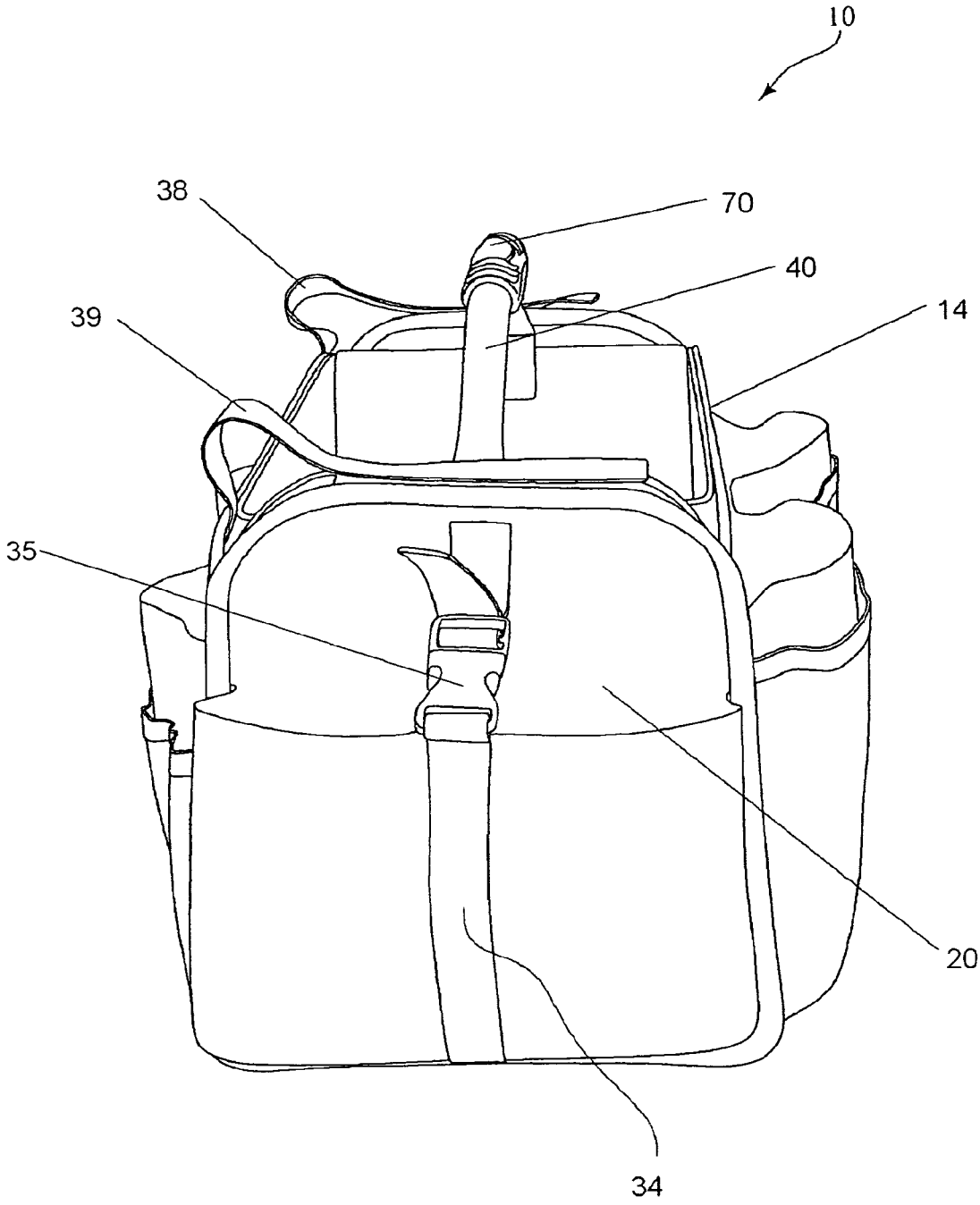
FIG. 8 is an alternate end perspective view of the tool case of FIG. 1.

With reference to FIGS. 7 and 8, a pocket 34 is provided on an outside surface of a fourth wall 20, which pocket 34 may be selectively closed using a clip 35.

With reference to FIGS. 2 and 5-8, a pair of straps 38, 39 is positioned at the top of the second wall 16 and the fourth wall 20 for securing items to the tool case 10 using hook-and-loop fastening material.

Figure 9:
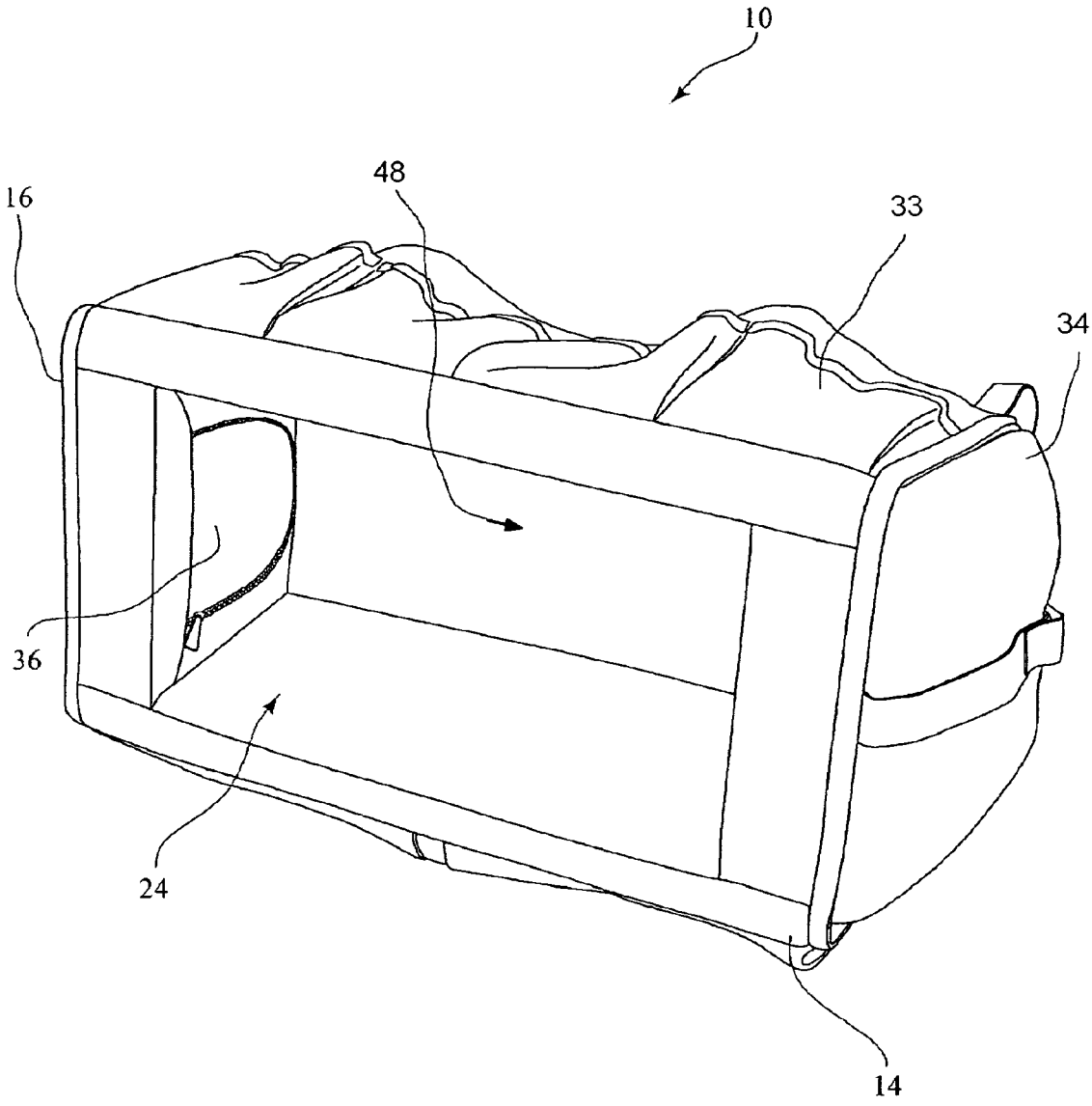
FIG. 9 is a bottom perspective view of the tool case of FIG. 1.

Finally, with reference to FIG. 9, a zip-closure compartment 36 is provided on an inside surface of the second wall 16.

Of course, the foregoing are merely examples of some of the holding mechanisms that may be used for securing and organizing tools and accessories of various shapes and sizes and any such mechanisms may be incorporated into the tool case without departing from the spirit and scope of the present invention.

As mentioned above, it is contemplated that the tool case could also include a casing made from a flexible material, such as a polymer or metal sheet that provides a stable surface, but may be flexed. The casing may be positioned substantially adjacent to the horizontal bottom surface and the vertical surface defining the cavity. As such, a space may be defined between the horizontal bottom surface and the vertical surface defining the cavity.

Figure 3:
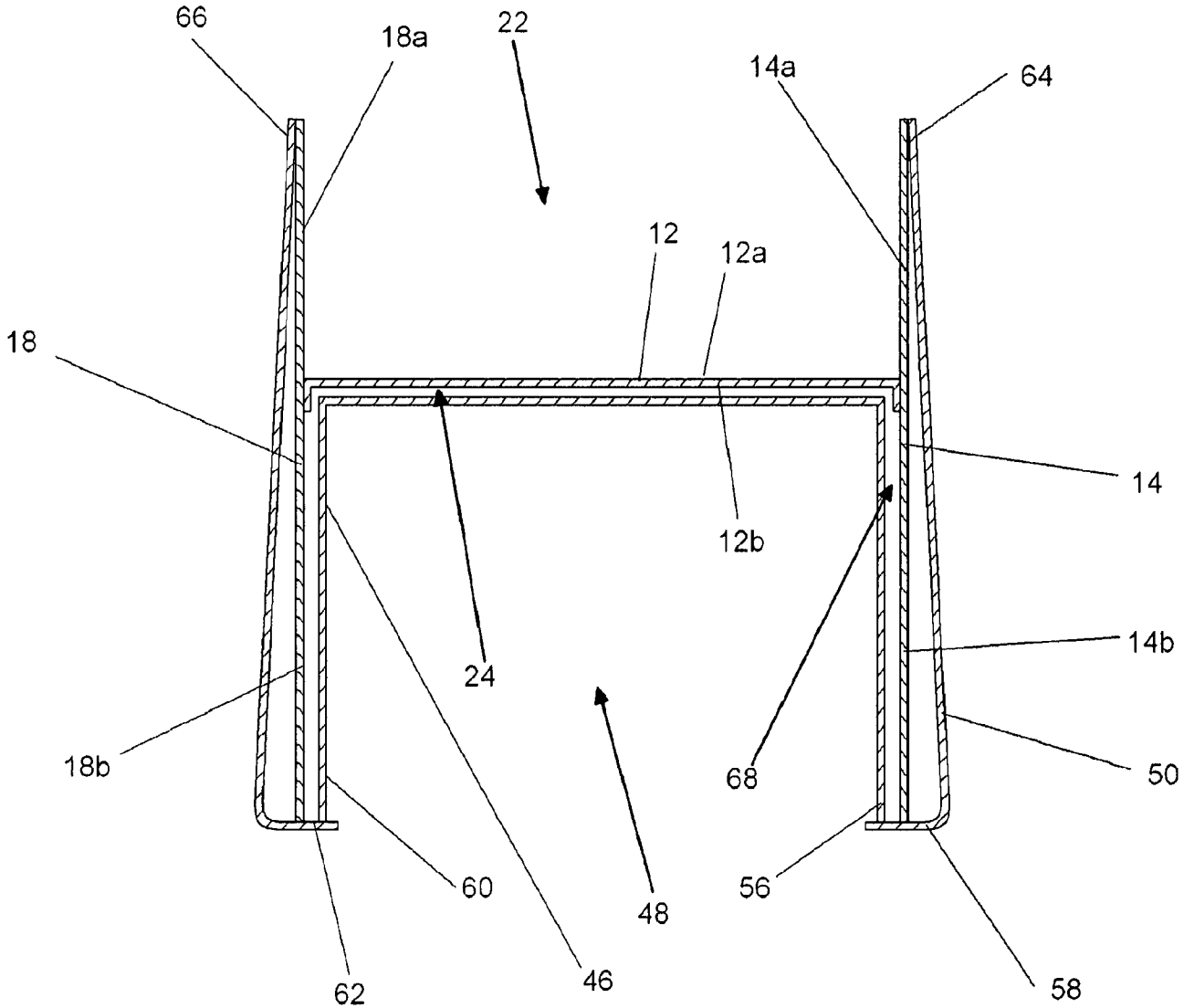
FIG. 3 is a cross-section view of the tool case of FIG. 1, taken along line 3-3 of FIG. 2.
Figure 4:
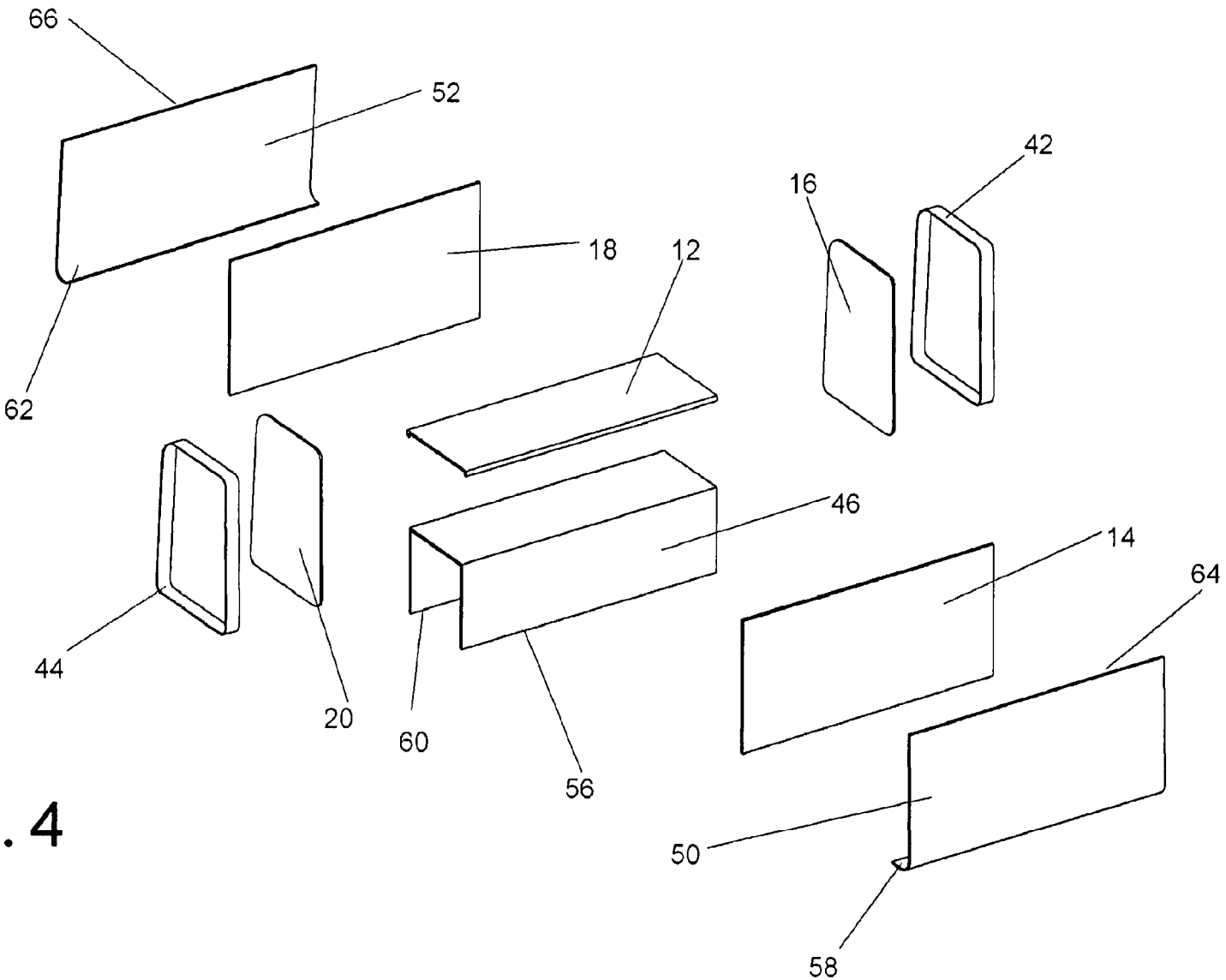
FIG. 4 is an exploded perspective view of the skeleton and casing of the tool case of FIG. 1.

The illustrated embodiment of the tool case 10 includes such a casing, best shown in FIGS. 3 and 4, which includes: a saddle 46 defining a channel 48; and a pair of generally "L"-shaped flaps 50, 52.

The casing allows for the tool case 10 to be snuggly and stably mated with the upper portion of a ladder 100. The saddle 46 is positioned within the cavity 24 and the channel 48 is shaped to snuggly receive the top portion of a ladder. A first edge 56 of the saddle 46 is joined to a lower end 58 of one flap 50 and a second edge 60 of the saddle 46 is joined to a lower end 62 of the other flap 52. Upper ends 64, 66 of each flap 50, 52 are joined to the side walls 14, 18, respectively. Thus, a shock-absorbing space 68 remains between the skeleton 12, 14, 16, 18, 20 and the casing 46, 50, 52; for example, a space remains between the saddle 46 and the bottom surface 12*b* of the base 12, a space remains between the saddle 46 and the lower portions 14*b*, 18*b* of the sidewalls 14, 18, and a space remains between the side walls 14, 18 and the flaps 50, 52. This space 68, along with the flexible nature of the casing material, provides certain benefits.

For example, the space 68 and flexible nature of the casing material allows the tool case 10 to be snuggly positioned on top of ladders having upper portions that differ. For another example, because the saddle 46 has the ability to move within the cavity 24, it can be readily guided around the top portion of a ladder. That is to say, the tool case 10 can brought into contact with the ladder 100 such that it forms an angle with the platform 140 before being rotated over the top portion of the ladder 100 to a substantially horizontal orientation.

For yet another example, the space 68 and flexible nature of the casing material allows the tool case 10 to move slightly while positioned on the ladder 100, which movement provides a certain stability. That is to say, when a tool is accessed from the tool case 10, a force is exerted upon the tool case 10, which force is absorbed by the space 68 and flexible nature of the casing material, such that the force is not transferred to the ladder, which transfer could cause the ladder to become unstable.

In any event, regardless of the particular components making up the skeleton and casing (in embodiments where a casing is provided), as mentioned above, it is contemplated that the tool case could be covered with fabric. In the illustrated embodiment, the skeleton and casing of the tool case 10 are covered with fabric, with the holding mechanisms, including, for example, the open pockets 26, 27, 31, 33, provided on the exposed fabric covered surfaces. In fabric-covered embodiments of the tool case, as an alternative to being constructed from a flexible material, the casing, including the saddle 46 and the flaps 50, 52, could be constructed from a substantially rigid material, having a multi-piece construction, which multiple rigid pieces may be separated and joined by the fabric, thereby imparting a degree of flexibility to the components of the casing, notwithstanding the individual pieces being constructed from a rigid material.

In the illustrated embodiment, the tool case 10 additionally includes a handle 40 that may be secured to the case 10 to allow the case 10 to be more easily carried. The handle 40 is secured to the inside surface of the second wall 16 and an inside surface of the third wall 20 and has a rigid construction with a padded grip 70 for supplying a comfortable and slip-resistant area on the handle 40 for grasping the tool case 10.

The illustrated embodiment of the tool case 10 additionally includes a pair of flanges 42, 44 extending from side walls 16, 20. The flanges 42, 44 provide added surface area that may be used for anchoring holding mechanisms, for example, the straps 38, 39. Additionally, the flanges 42, 44 provide some protection for tools and accessories secured by holding mechanisms on side walls 16, 20; for example, if the tool case 10 was forced against a wall, the flanges 42, 44, rather than holding mechanisms on side walls 16, 20, would come in contact with the wall. The flanges 42, 44 may each be constructed from a substantially rigid or a flexible material, such as a polymer or metal sheet that provides a stable surface, but may be flexed. Additionally, the flanges 42, 44 may have an integral or multi-piece construction. In embodiments where the flanges 42, 44 have a multi-piece construction, the multiple pieces may be separated and joined by the fabric to provide a degree of flexibility.

The illustrated embodiment of the tool case 10 may be used in the following manner. With reference to FIG. 1, an exemplary ladder 100 that may be used with the tool case 10 includes a pair of rails 110 with a plurality of substantially horizontal steps 120 extending therebetween. The tops of the rails 110 terminate at a platform 140. The platform 140 has a pair of downwardly extending legs 130 pivotally attached thereto, which, along with the rails 120, support the ladder 100 while it is being used.

The tool case 10 is designed to engage the ladder 100 by lowering the tool case 10 onto the ladder 100 such that the top portion of the ladder is contained within the channel 48 defined by the saddle 46 of the casing. In other embodiments that do not include a casing, the tool case may be lowered onto the ladder 100 such that top portion of the ladder is contained within the cavity defined by the horizontal bottom surface and at least one vertical surface extending therefrom, such that the horizontal bottom surface rests on the platform 140 of the ladder 100. For example, with reference to the skeleton of the illustrated embodiment, the tool case 10 may be lowered onto the ladder 100 such that the top portion of the ladder 100 is contained within the cavity 24 defined by the bottom surface 12*b* of the base 12 and the lower portions 14*b*, 16*b*, 18*b*, 20*b* of the side walls 14, 16, 18, 20, such that the bottom surface 12*b* rests on the platform 140 of the ladder 100. When the tool case 10 is so positioned, the portion of the walls 14*b*, 16*b*, 18*b*, 20*b* that extend downwardly from the base 12 of the case 10 surround the platform 140, a top portion of the rails 110 and a top portion of the legs 130. That is to say, the cavity 24 receives and retains a top portion of the ladder 100, allowing the tool case 10 to engage the ladder 100.

Although the terms horizontal and vertical sometime appear unmodified in this document; these terms are at all times to be understood as being modified by the term "substantially," unless otherwise indicated.

One of ordinary skill in the art will also recognize that additional embodiments are possible without departing from the teachings of the present invention or the scope of the claims which follow. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A tool case for engaging a ladder, comprising:

a substantially rigid skeleton, having a substantially horizontal top surface;

a first substantially vertical upper wall, extending upward from said substantially horizontal top surface, said first substantially vertical upper wall and said substantially horizontal top surface defining a compartment;

a substantially horizontal bottom surface; and first, second, third and fourth substantially vertical lower walls, extending downward from first, second, third and fourth edges, respectively, of said substantially horizontal bottom surface, said substantially horizontal bottom surface and said first, second, third and fourth lower walls defining a cavity for receiving a top portion of the ladder, wherein said first and third edges are opposite one another and said second and fourth edges are opposite one another;

at least one holding mechanism attached to the skeleton for securing tools and accessories to the tool case; and a flexible casing that is positioned within said cavity and substantially adjacent and substantially parallel to said substantially horizontal bottom surface, said first lower wall, and said third lower wall, wherein a space is defined between said casing and said substantially horizontal bottom surface, said first lower wall, and said third lower wall of said skeleton.

2. The tool case of claim 1, wherein said at least one holding mechanism is provided on an exterior of the skeleton.

3. The tool case of claim 1, wherein said casing comprises a saddle positioned within the cavity and defining a channel for receiving the top portion of the ladder.

4. The tool case of claim 3, wherein said casing further comprises a pair of flaps joining said saddle to said skeleton, said flaps extending along an exterior of said first and third lower walls.

5. The tool case of claim 4, wherein a second space is defined between said flaps and said first and third lower walls of said skeleton.

6. The tool case of claim 1, wherein one or more walls provide said vertical upper wall extending from said horizontal top surface.

7. The tool case of claim 6, wherein a base provides said horizontal top surface and said horizontal bottom surface.

8. The tool case of claim 6, wherein said at least one holding mechanism is provided on an exterior of the skeleton.

9. A tool case for engaging a ladder, comprising:

a base; and first, second, third and fourth side walls extending from said base and having upper portions and lower portions, wherein said base and said upper portions of said side walls define a compartment for holding tools and said base and said lower portions of said side walls define a cavity for receiving a top portion of the ladder and said base, wherein said first and third side wall are opposite one another and said second and fourth side walls are opposite one another; and a flexible casing that is positioned substantially adjacent and substantially parallel to a substantially horizontal bottom surface of said base and said first and third lower portions within said cavity, wherein a space is defined between said casing and said substantially horizontal bottom surface and said first and third lower portions.

10. The tool case of claim 9, wherein said base and at least one of said side walls are substantially rigid.

11. The tool case of claim 9, further comprising at least one holding mechanism provided on an exterior of at least one of said side walls for securing tools and accessories to the tool case.

12. The tool case of claim 9, wherein said casing comprises a saddle positioned within the cavity and defining a channel for receiving the top portion of the ladder.

13. The tool case of claim 12, wherein said casing further comprises a pair of flaps joining said saddle to said one or more side walls, said flaps extending along an exterior of said first and third walls.

14. The tool case of claim 9 further including a handle attached to said upper portions of said one or more side walls.

* * * * *